United States Patent [19]

Ostrowsky et al.

[11] 3,954,201

[45] May 4, 1976

[54] HOUSING FOR CONTAINER

[75] Inventors: Efrem M. Ostrowsky, Highland Park, Ill.; Anthony F. Schepis, Pelham Manor, N.Y.

[73] Assignees: VCA Corporation, Baton Rouge, La.; Chanel, Inc., New York, N.Y.

[22] Filed: Sept. 17, 1975

[21] Appl. No.: 614,008

[52] U.S. Cl. ..... 220/4 F; 220/326

[51] Int. Cl.[2] ..... B65D 7/00; B65D 45/16

[58] Field of Search ..... 220/4 R, 4 F, 66, 67, 220/76, 306, 315, 324, 281, 307, 323, 326

[56] References Cited

UNITED STATES PATENTS

| | | | |
|---|---|---|---|
| 3,532,840 | 10/1970 | Bauer | 220/324 X |
| 3,913,774 | 10/1975 | Vajtay | 220/315 |

*Primary Examiner*—George E. Lowrance
*Assistant Examiner*—Steven M. Pollard
*Attorney, Agent, or Firm*—Donald L. Johnson; John F. Sieberth; Edgar E. Spielman, Jr.

[57] ABSTRACT

A housing for holding containers therein is disclosed. The housing features an open-bottomed, elongated, hollow body member which member has the conventional sidewalls and top wall, and a removable bottom wall member which cooperates with the open bottom of the elongated, hollow body member to close off the bottom thereof. Latching members, which are part of the bottom wall member, are lockably engageable with engaging members formed in the interior and at the bottom portion of the elongated, hollow body member. The latches lock the bottom wall member to the elongated, hollow body member by means of force exerted by torsion members connected to the latching members and carried by the bottom wall member.

24 Claims, 14 Drawing Figures

HOUSING FOR CONTAINER

BACKGROUND OF THE INVENTION

In containerizing products, manufacturers have for many years realized the value of presenting an attractive package to the purchaser. As a general rule, the more attractive the package the more expensive it is for the manufacturer to containerize his product. It would be desirable then if the manufacturer containerized his product in an non-decorative container, which containers are very inexpensive, and surrounded or housed the undecorated container with a decorative housing.

Utilization of such housings is often fraught with mechanical difficulty in devising easily removable portions of the housing so that the consumer may remove the undecorated container from the housing and replace it with a full container. Much difficulty is realized when dealing with containers of small size due to the fact that the human hand is often too large to get into the small areas required to remove a wall of the housing.

Therefore it is an object of this invention to provide a reusable housing for containers which permits easy removal and replacement of the container. It is also a further object of this invention to provide a housing having a minimum number of cooperating parts.

THE INVENTION

This invention relates to a housing for holding a container therein which housing comprises: an elongated, hollow body having an open bottom, the hollow body being dimensioned such that the container is fittable therein; engaging members attached to the interior of the hollow body and adjacent to the open bottom; a removable bottom wall cooperative with the hollow body for closing off the open bottom; and latching members cooperative with the engaging members to removable hold the bottom wall to the hollow body, the latching members being attached to the bottom wall by torsion members whereby the latching members are in torsion when the latching members are in cooperation with the engaging members.

In preferred form the housing of this invention features a removable bottom wall having integrally formed latching members and torsion members. This feature is highly desirable as it enables the manufacturer to cheaply produce these components as a single unit, such as by injecting molding. In another preferred form the latching members are of a generally inverted "T" shape. One of the horizontal members of the "T" engages with an inwardly extending lip of the hollow body to achieve the latch position. Torsion bars extend from the uppermost end of the generally vertically extending member of the "T" to cause the engaging horizontal member to exert an outward pressure on the inside wall of the hollow body portion adjacent the extending member. Projecting downwardly and through an opening in the bottom wall is a latch release which is attached to the other horizontally extending member of the inverted "T". The human finger is able to engage the latch release through the opening in the bottom wall. An even further preferred embodiment of this invention features secondary holding means to aid the latch members in maintaining the bottom wall to be elongated, hollow body member. These secondary holding means can simply be provided by a ridge carried in the hollow body member which cooperates with grooves carried by the bottom wall.

These and other features of the invention contributing satisfaction in use and economy in manufacture will be more fully understood from the following description of preferred embodiments of the invention when taken in connection with the accompanying drawings, wherein identical numerals refer to identical parts and in which.

Figure 1:
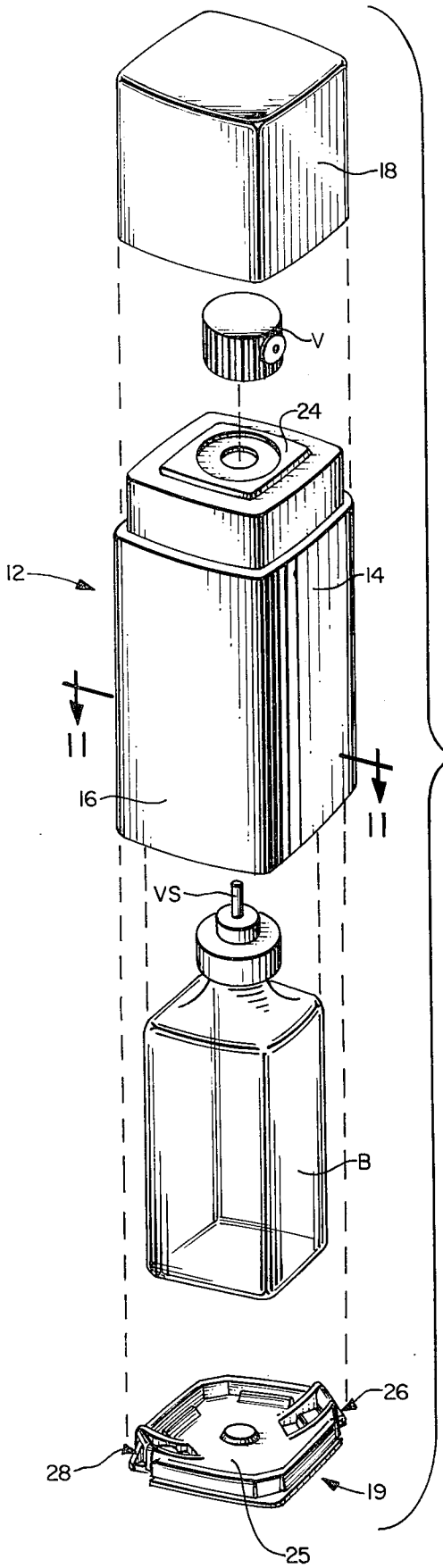
FIG. 1 is an exploded perspective view of a housing of this invention with its accompanying container.
Figure 2:
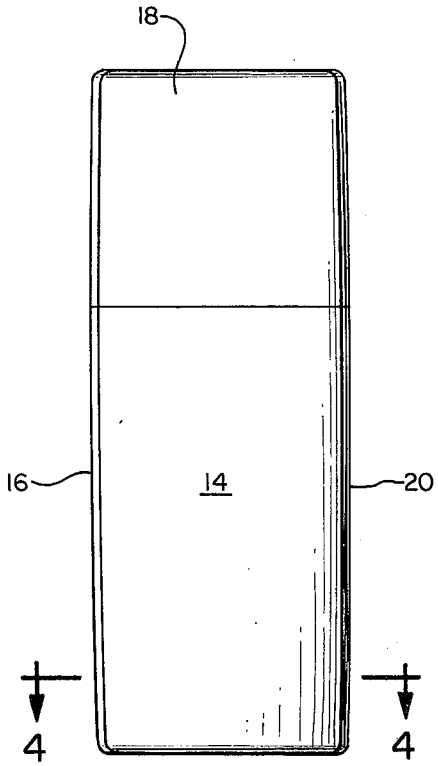
FIG. 2 is a side elevational view of the embodiment shown in FIG. 1.
Figure 3:
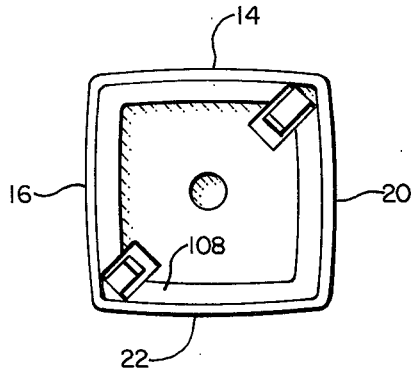
FIG. 3 is a bottom plan view of the embodiment shown in FIG. 1.
Figure 4:
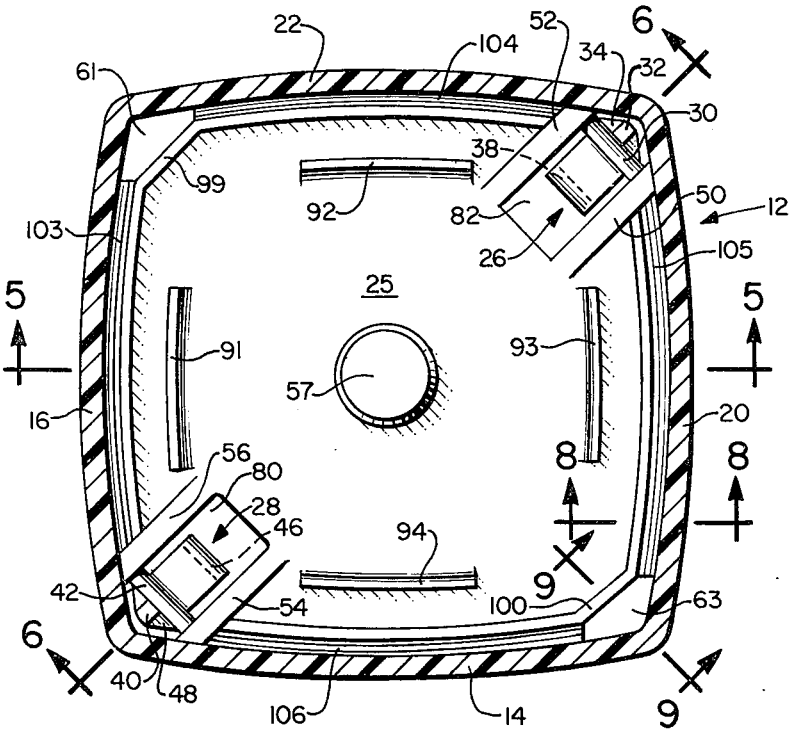
FIG. 4 is a sectional view taken through section lines 4—4 of FIG. 2.

As can be seen in FIG. 1, a housing of this invention has a hollow body portion, generally designated by the numeral 12, a cap 18 which fits over the top of hollow body portion 12 and a bottom portion, generally designated by the numeral 19. As can be seen in FIG. 1, bottle "B" fits within hollow body portion 12 with valve stem "VS", in the case of pressurized bottles, protruding through an opening in top wall 24 of hollow body portion 12 for receipt of valve cap "V". In the particular body illustrated, hollow body portion 12 has a configuration which can be generally described as rectangular in cross-section. When this configuration is used, hollow body portion 12 will have sidewalls 14, 16, 22 and 20. It is to be understood of course that other configurations may be utilized without deviating from the scope of this invention.

Figure 5:
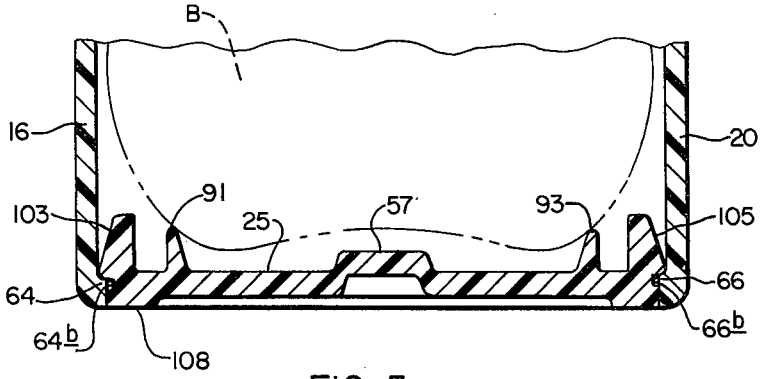
FIG. 5 is a sectional view taken along section lines 5—5 of the FIG. 4.

Bottom portion 19 has a bottom wall 25. As can be seen in FIG. 5, bottom wall 25 has a downwardly projecting peripheral ledge 108 which is about the periphery of bottom wall 25. Projecting upward from bottom wall 25 are guide walls 91, 92, 93 and 94 which, in conjunction with guide 57, aid in positioning bottle "B" within the hollow body portion 12 when bottom wall 19 is placed into position closing off the bottom of hollow body portion 12.

Bottom portion 19 carries two latching mechanisms generally designated by the numerals 26 and 28 which act in cooperation with engaging members, hereinafter described, in the bottom portion of hollow body portion 12. Since these latches are identical, description of structure for one latch is applicable to the other latch.

Figure 7:
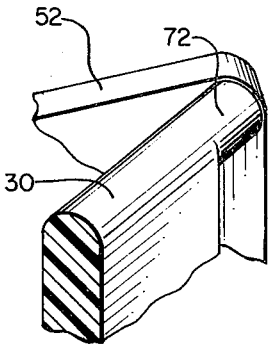
FIG. 7 is an enlarged view of the one of the torsion members for one of the latches shown in FIG. 1.
Figure 12:
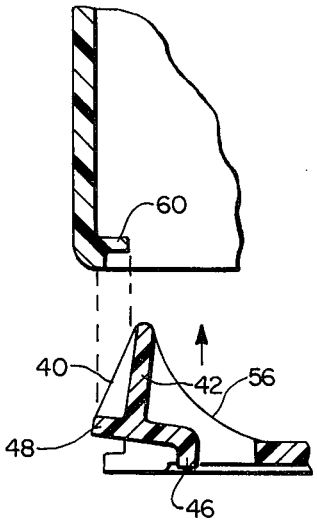
FIG. 12 is a sectional view of the latch and bottom portion of the hollow body portion shown in FIG. 1 showing the position of the latch prior to insertion into the hollow body portion.

Latch 26 is mounted on latch support arms 52 and 50, which arms project upwardly from and are integrally formed with bottom wall 25. Latch support arms 56 and 54 have the same function for latch 28. Attached at the upper end of latch support arms 50 and 52, and in this embodiment integral therewith, are torsion rods 72 and 70. As can be seen from FIG. 10 and FIG. 7, torsion rods 72 and 70 are integral with downwardly extending latch member 30. When the latches of this invention are in a relaxed position torsion rods 72 and 70 (and in the case of latch 28 torsion rods 74 and 75) are biased so that the downwardly extending latch member 30 for latch 26 and 42 for latch 28, are biased in an upward position as is shown in FIG. 12. It is to be understood that while the embodiment shown in the drawings features support arms, torsion rods and downwardly extending latch members being integrally formed one with the other, it is within the scope of this invention to utilize the torsion principle to achieve the bias spoken of and depicted in FIG. 12 without having integral formation of all of these members.

Figure 10:
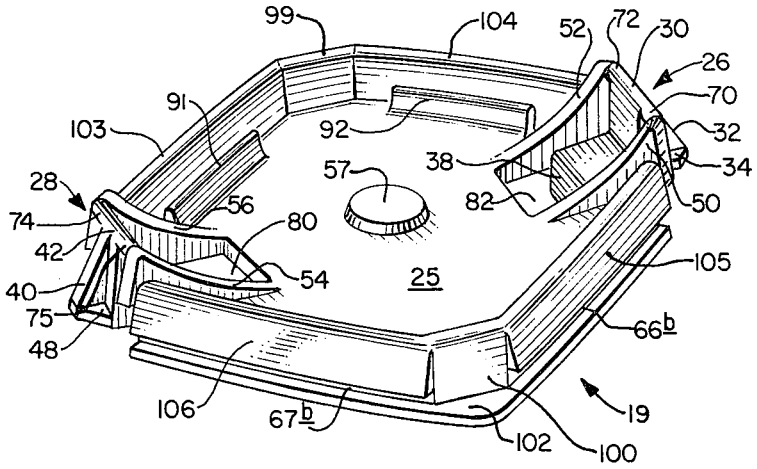
FIG. 10 is an enlarged perspective view of the bottom portion shown in FIG. 1.

As can be seen in FIGS. 10 and 12, downwardly extending latch member 30, in the case of latch 26, and downwardly extending member 42, as in the case for latch 28, intersect latch lips 34 and 48 respectively. Also intersecting downwardly extending latch members 42 and 30 are latch release projections 46 and 38 respectively. The distal ends of latch release projections 38 and 46 are in proximity to latch release apertures 82 and 80 respectively. Latch release apertures 80 and 82 are sized so that the human finger is able to engage latch release projections 46 and 38 to effect release of the latches so that bottom portion 19 can be removed from hollow body portion 12 as hereinafter described.

Figure 11:
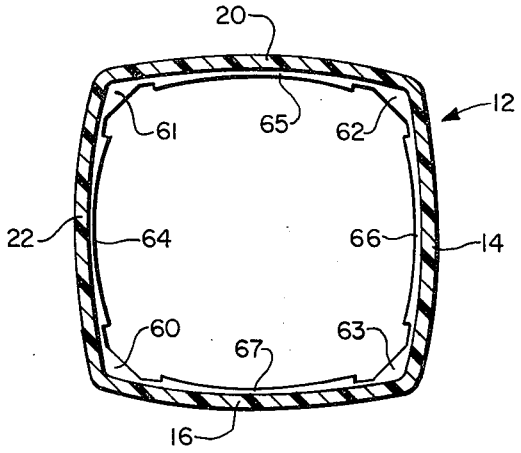
FIG. 11 is a sectional view taken through section lines 11—11 of FIG. 1.

Providing structure with which latches 26 and 28 may act to achieve firm holding of bottom portion 19 to hollow body portion 12 are engaging lips 60 and 62. Engaging lips 61 and 63 are also provided and may be utilized should bottom portion 19 be disposed 90° from the position shown in the figures. As can be seen in FIG. 11, engaging lips 60, 61, 62 and 63 are located at the corners of hollow body portion 12. This location is desirable as the engaging lips can have a larger depth than if they were located along any one of sidewalls 14, 16, 20 or 22. Therefore in a preferred embodiment, engaging lips 60, 61, 62 and 63 are located at the corners of hollow body portion 12. Also it is obvious that latches 26 and 28 must also be located at the corners of bottom portion 19 so that they are in position to engage engaging lips 60 and 62 or 61 and 63.

Figure 12A:
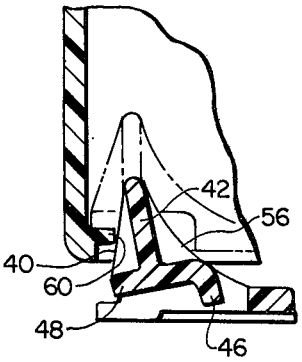
FIG. 12A shows the position of the latch as it rides into the hollow body portion to achieve latching.
Figure 13:
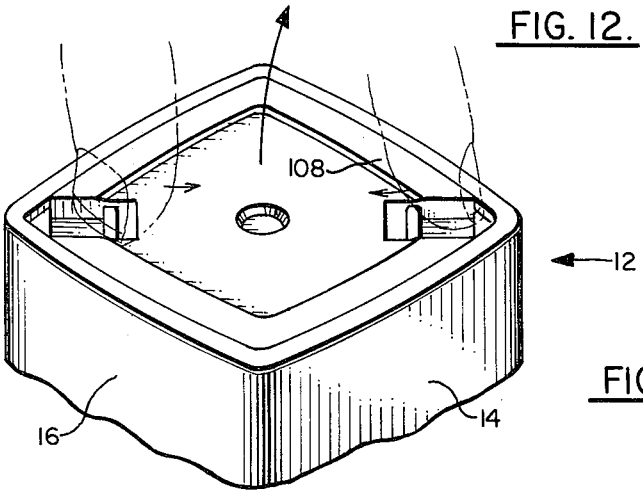
FIG. 13 is a partial perspective view showing the manner in which the human fingers are utilized to effect opening of the latch and removal of the bottom portion from the hollow body portion.

As is evident from FIGS. 12 and 12A, latch lips 48 and 34, when in latching position, will overlie the engaging lips. To achieve this position it is required that a rotation of the latch lips be accomplished when bottom portion 19 is being inserted into the open end of hollow body portion 12. It can be seen in FIG. 12A, this rotation is achieved by engaging lip 60 acting against latch cam 40 to cause latch lip 48 to rotate inwardly thus moving it out of an interferring position with engaging lip 60. Latch cam 32 for latch 26 is comparable to latch cam 40. As can be appreciated, this rotation is taking place under torsional stress due to flexing of torsion rods 74 and 75 from their normally relaxed position as shown in FIG. 12. Once latch lip 48 is above engaging lip 60, torsion rods 74 and 75 will cause latch lip 48 to rotate back outwardly until it meets the corner wall of hollow body portion 12. Since the relaxed position shown in FIG. 12 is still not being reached even when latch lip 48 is over engaging lip 60, torsion rods 74 and 75 are still exerting an outward rotational force upon latch lip 48. This aids in providing integrity for the latching qualities of latches 28 and 26. An identical mechanism is provided for latch 26.

In some instances it may be desirable to provide secondary holding means to aid in holding bottom portion 19 to hollow body portion 12. This will be especially so if bottle "B" is a pump type aerosol dispenser which requires a downward force for its operation. In this instance it is preferable that a secondary holding mechanism be provided. The embodiment shown in the drawings provides such a mechanism.

Figure 8:
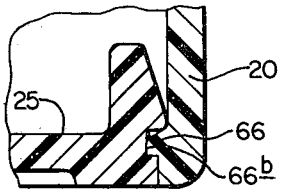
FIG. 8 is a sectional view taken along section lines 8—8 of FIG. 4.

In FIG. 11 there can be seen secondary holding ridges 67, 66, 64 and 65. As can also be seen in FIG. 11, these ridges diminish in depth as they approach the center of their respective sidewalls. Such a tapered configuration is desirable as there is a lessening of resistance to positioning of bottom portion 19 without unacceptable loss in holding power by the secondary holding mechanisms. To receive secondary holding ridges 64, 65, 66 and 67 are secondary holding grooves **67*B*, 64*b* 66*b*. The groove to receive secondary holding ridge 65 is not shown but is identical to the other holding grooves. As can be seen in FIGS. 5 and 8, the secondary holding ridges project into the secondary holding grooves thus achieving a snaplock type latching. Immediately above the secondary holding grooves are secondary holding cam walls 103, 104, 105 and 106.** As can be seen from the drawings, these cam walls have a beveled outside surface to aid in snapping the secondary holding ridges within the secondary holding grooves.

Figure 9:
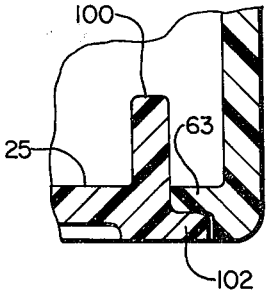
FIG. 9 is a sectional view taken through section lines 9—9 of FIG. 4.
Figure 6:
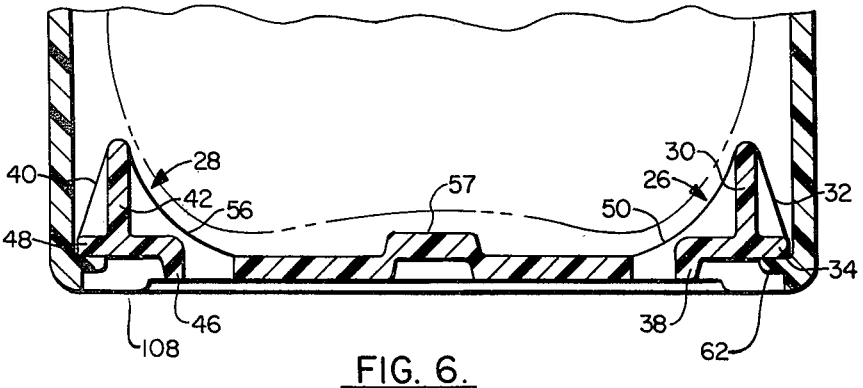
FIG. 6 is a sectional view taken along section lines 6—6 of FIG. 4.

In the particular embodiment shown, engaging lips 61 and 63 are not in communication with latches 26 and 28. However these lips are utilized in conjunction with corner holding ridge 102 and its twin which is oppositely disposed on bottom portion 19 but is not shown. Also corner walls 100 and 99 abut up against the inside edges of engaging lips 63 and 61 respectively. This relationship is shown in FIG. 9 and as can be seen corner holding ridges 102 are disposed beneath latching lip 63 to aid in keeping bottom portion 19 from being pushed too far into hollow body portion 12.

In operation the apparatus of this invention is the paragon of simplicity. The user of this invention needs to merely take bottom portion 19 and insert it into the open end of hollow body portion 12. Camming surfaces hereinabove described aid in achieving the latching position shown in FIGS. 5–9 and 12A. To remove bottom portion 19, the user need only to engage latch release projections 38 and 46 and pull them towards the inside of bottom portion 19. This will cause rotation of latch lips 48 and 34 so that they will jump off of their latch positions above their respective engaging lips. A small amount of force then upon the bottle will cause secondary holding mechanisms to release and bottom portion 10 can be removed and bottle "B" can be replaced.

Hollow body portion 12 and cap 18 may be of any suitable material. Exemplary of materials which are highly useful are polyester, polyacetal, nylon, metals such as tin and steel, and thermoplastics such as polyethylene or polypropylene. The bottom portion 19 should be of a material which is resiliently deformable if the latch members and torsion members are to be integrally formed with the bottom portion. Exemplary of suitable resiliently deformable materials are thermoplastics such as nylon, polyacetal, high density polyethylene or polyester. Of these materials polypropylene or polyester is most preferred. If the latch members and torsion members are not integrally formed with the bottom portion, then only they need be of a material which is resiliently deformable. In these instances the bottom portion may be of any suitable material such as the material of which the hollow body portion and cap are made of.

What is claimed:

1. A housing for holding a container therein which housing comprises:

a. an elongated, hollow body having an open bottom, said holding body being dimensioned such that said container is fittable therein;

b. engaging means attached to the interior of said hollow body and adjacent to said open bottom;

c. a removable bottom wall cooperative with said hollow body for closing off said open bottom; and d. latching means cooperative with said engaging means to removably hold said bottom wall to said hollow body, said latching means being attached to said bottom wall by torsion means whereby said latching means are in torsion when said latching means is in cooperation with said engaging means.

2. The housing of claim 1 wherein said torsion means are integrally formed with said latching means.

3. The housing of claim 2 wherein said torsion means is at least two rods projecting from said latching means.

4. The housing of claim 3 wherein said rods are integrally formed with a support means which is in turn integrally formed with said bottom wall.

5. The housing of claim 1 wherein said engaging means comprises at least one inwardly extending engaging lip for each of said latching means.

6. The housing of claim 5 wherein said engaging lip is in a plane substantially parallel to a plane passing horizontally through said bottom wall.

7. The housing of claim 5 wherein said latching means has an outwardly projecting lip which engages said engaging lip and is held in engagement therewith by means of torsion applied by said torsion means.

8. The housing of claim 7 wherein said latching means additionally have a projection which extends through an opening in said bottom wall whereby said latching means can be arcuately moved about said torsion means by application of force from a human finger to disengage said outwardly projecting lip from said engaging lip for removal of said bottom wall from said hollow body.

9. The housing of claim 8 wherein said projecting lip overrides said engaging lip when in engagement.

10. The housing of claim 9 wherein said latching means has a camming means which extends to the edge of said outwardly projecting lip so that the outwardly projecting lip can ride over said engaging lip to achieve said overlying position when said bottom wall is being attached to said hollow body.

11. The housing of claim 9 wherein said latching means comprises:

a. a downwardly extending member, b. an elongated, horizontal member connected to said downwardly extending member, one end of said horizontally extending member forming said outwardly projecting lip, and said other end of said horizontally extending member carrying said projection, the end of said downwardly extending member opposite the connection of said downwardly extending member and said horizontally extending member being attached to said torsion means.

12. The housing of claim 1 wherein said hollow body additionally has a secondary hollow body holding means and said bottom wall additionally has a secondary bottom wall holding means, both holding means aiding said latching means and said engaging means in holding said bottom wall to said hollow body.

13. The housing of claim 12 wherein said secondary hollow body holding means is an inwardly extending ridge on the inside of the bottom portion of said hollow body and said secondary bottom wall holding means is a groove for receipt of at least a portion of said ridge.

14. The housing of claim 1 wherein said bottom wall additionally has stabilizing means extending upward from the inside face of said bottom wall for stabilizing said container.

15. The housing of claim 1 wherein said hollow body has a rectangular shape when viewed from a horizontal plane through said body, and said bottom wall is of a similar rectangular shape to accommodate fitting of said bottom wall to said hollow body.

16. The housing of claim 15 wherein said latching means are located at at least one of the corners of said bottom wall.

17. The housing of claim 16 wherein there are two latching means.

18. The housing of claim 17 wherein said torsion means is at least two rods projecting from each of said latching means and connected to a support means carried by said bottom wall, said support means being a pair, for each of said latch means, of spaced apart arms which extend upwardly from the inside face of said bottom wall.

19. The housing of claim 18 wherein said engaging means comprises at least one inwardly extending engaging lip for each of said latching means.

20. The housing of claim 19 wherein said latching means has an outwardly projecting lip which engages said engaging lip and is held in engagement therewith by means of torsion applied by said rods.

21. The housing of claim 20 wherein each of said latching means additionally has a projection which extends through an opening in said bottom wall whereby said latching means can be arcuately moved about said torsion means to disengage said outwardly projecting lip from engaging lip for removal of said bottom wall from said hollow body.

22. The housing of claim 21 wherein said outwardly projecting lip overlies said engaging lip.

23. The housing of claim 22 wherein said latching means has a camming means which extends to the edge of said outwardly projecting lip so that said outwardly projecting lip can ride over said engaging lip to achieve said overlying position when said bottom wall is being attached to said hollow body.

24. The housing of claim 23 wherein said latching means comprises:

a. a downwardly extending member;

b. an elongated, horizontal member connected to downwardly extending member, one end of said horizontally extending member forming said outwardly projecting lip, and said other end of said horizontally extending member carrying said projection the end of said downwardly extending member opposite the connection of said downwardly extending member and said horizontally extending member being attached to said torsion means.

* * * * *

UNITED STATES PATENT OFFICE

CERTIFICATE OF CORRECTION

PATENT NO. : 3,954,201

DATED : May 4, 1976

INVENTOR(S) : Efrem M. Ostrowsky and Anthony F. Schepis

It is certified that error appears in the above-identified patent and that said Letters Patent are hereby corrected as shown below:

Col. 1, line 50, reads "injecting" should read --injection--. Col. 2, line 22 reads "of the one" should read --of one--. Col. 2, line 63 reads "guide 57" should read --guide post 57--. Col. 4, line 28 reads "67B" should read --67b--. Col. 4, line 63 reads "10" should read --19--. Col. 5, line 6, reads "polyethylene or polyester" should read --polyethylene, polypropylene or polyester--. Col. 5, line 19 reads "holding" should read --hollow--. Col. 6, line 53 reads "from engaging" should read --from said engaging--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*